United States Patent [19]

Suzuki et al.

[11] Patent Number: 5,052,295

[45] Date of Patent: Oct. 1, 1991

[54] PAPER WEB THREADING APPARATUS FOR ROTARY PRINTING PRESS

[75] Inventors: Kunio Suzuki; Tomoshi Kawata, both of Yokohama, Japan

[73] Assignee: Kabushiki Kaisha Tokyo Kikai Seisakusho, Tokyo, Japan

[21] Appl. No.: 584,228

[22] Filed: Sep. 18, 1990

[30] Foreign Application Priority Data

Sep. 20, 1989 [JP] Japan ..... 1-241681
Nov. 21, 1989 [JP] Japan ..... 1-302807

[51] Int. Cl.[5] ..... B41F 13/56

[52] U.S. Cl. ..... 101/227; 226/92; 162/194; 242/58.1; 242/58.5

[58] Field of Search ..... 101/226, 227, 219, 224, 101/228; 226/91, 92; 162/194; 34/117, 120; 242/58.1-58.5

[56] References Cited

U.S. PATENT DOCUMENTS

| | | | |
|---|---|---|---|
| 2,944,345 | 7/1960 | Faeber . | |
| 3,127,079 | 3/1964 | Allander . | |
| 3,761,001 | 9/1973 | Bolza-Schunemann et al. . | |
| 3,995,553 | 12/1976 | Winterholler et al. . | |
| 4,070,965 | 1/1978 | Aienishaenslin et al. | 101/219 |
| 4,078,487 | 3/1978 | McComb | 101/228 |
| 4,111,122 | 9/1978 | Kutzner et al. . | |
| 4,308,798 | 1/1982 | Carlton . | |
| 4,370,927 | 1/1983 | Fischer . | |
| 4,706,862 | 11/1987 | Theilacker . | |
| 4,747,254 | 5/1988 | Lancaster . | |
| 4,815,220 | 3/1989 | Wedel . | |
| 4,819,557 | 4/1989 | Handschuher . | |
| 4,831,926 | 5/1989 | Bowman et al. . | |
| 4,854,053 | 8/1989 | Skaugen . | |
| 4,904,344 | 2/1990 | Peiffer . | |

FOREIGN PATENT DOCUMENTS

| | | |
|---|---|---|
| 038450 | 10/1981 | European Pat. Off. . |
| 355026 | 2/1990 | European Pat. Off. . |
| 2196909 | 3/1974 | France . |

*Primary Examiner*—Eugene H. Eickholt
*Attorney, Agent, or Firm*—Armstrong, Nikaido, Marmelstein, Kubovcik & Murray

[57] ABSTRACT

A paper web threading apparatus for a rotary printing press comprises a paper web threading member guide provided along a paper web threading path of the printing press extending from a paper web supply section to a position just in front of a folding section; a paper web threading member pooling section provided downstream of the paper web threading path; a paper web threading member which is located over the whole length of the paper web threading path extending from the most upstream position thereof to the paper web threading member pooling section upon commencement of the paper web threading operation and which is run along the paper web threading member guide towards the paper web threading member pooling section during the paper web threading operation; a paper web retaining member provided on the paper web threading member for securing the paper web to the threaded along the path; and at least one paper web threading member driving unit for running the paper web threading member along the paper web threading member guide. Thus, this paper web threading apparatus enables a paper web to be threaded along the paper web threading path smoothly at nearly constant speed without applying uneven tension to the paper web.

4 Claims, 11 Drawing Sheets

PAPER WEB THREADING APPARATUS FOR ROTARY PRINTING PRESS

BACKGROUND OF THE INVENTION

1. Field of the Invention

This invention relates to a paper web threading apparatus for a rotary printing press for threading a paper web through a paper web threading path extending from a paper web supply section through a printing section to a folding section to thereby conduct printing of the paper web, and more particularly to a paper web threading apparatus for effective use in a printing press having a paper web threading path which extends from a paper web supply section through a plurality of guide rollers and turning bars including a double ender device and a bay window device to a folding section, the arrangement being made such that the threading of a paper web is conducted by a paper web threading member adapted to be moved on and along a guide provided along a paper web threading path.

2. Description of the Prior Art

A prior art paper web threading apparatus for a rotary printing press is publicly known from, for example, the apparatus disclosed in Japanese Laid-Open Patent Application NO. HEI-1-103647. This prior art paper web threading apparatus comprises pipe-shaped guide rails provided with branched portions along a plurality of paper web threading paths and having a longitudinally extending slit formed on one side thereof, the guide rails each having notches formed at appropriate intervals therealong; driving units provided in the notches; running members adapted to be driven by the driving units so as to run on their respective guide rails in zigzag direction and having full length somewhat longer than the spacing between the notches; each of the running members having a clip secured thereto and adapted to detachably hold a paper web connecting adaptor connected to the cleading end of printing paper drawn out from a paper web roll disposed at a paper web supply section.

The above-mentioned prior art has posed the following problems.

Threading of a paper web in a rotary printing press is made from the upstream side of a paper web threading path to the downstream side thereof, namely, from a paper web supply section to a folding section. In this case, the paper web to be threaded along the path is guided by a comparatively short running member (which is referred to as short running member hereinbelow). In this case, since the driving members for driving the short running member are provided at intervals somewhat shorter than the length of the short running member, the short running member is driven by two sets of driving units along some part of the path, and by one set of driving units along the other part thereof so that the driving force exerted on the running member cannot be kept constant. Further when the short running member is passing through corners where the resistance to the running thereof is high, it is, decelerated by high friction thus causing unevenness in the running speed thereof so that the speed of the paper web connected to the short running member becomes uneven. As a result, in the course of threading of a paper web through a paper web threading path which requires reliability, such troubles such as, for example, slackening of paper web due to deceleration and formation of creases thereof, and also severance of paper web etc. have occurred.

Further, in case of printing newspaper, for example, the recent increases in pages and color-printing have required provision of a number of guide rollers and turning bars including double ender means and bay window means along a paper web threading path extending from a paper web supply section to a folding section, which resulted in considerable increase in the length of the paper web threading path as compared with that in the past. As a result, because the driving units for driving the short running member movable on the guide rail are provided at intervals somewhat shorter than the length of the short running member, it has become inevitable to provide larger member of driving units. Provision of a multiplicity of driving units not only increases the cost of printed matters, but also complicates the narrow interior of the frame of the rotary printing press, and also renders it difficult to carry out ordinary printing operation as well as maintenance/repairs and inspection, thus causing problems in terms of safe operation.

SUMMARY OF THE INVENTION

The present invention has been made in view of the above-mentioned circumstances in the prior art, and has for its object to provide a paper web threading apparatus for a rotary printing press which is capable of threading a paper web through a paper web threading path smoothly, surely and at nearly constant speed without applying and uneven tension to the paper web and whose construction is simple so that the frequency of troubles is limited and maintenance/repairs thereof can be carried out readily and safe operation can be achieved.

To achieve the above-mentioned object, according to a first aspect of the present invention, there is provided a paper web threading apparatus for a rotary printing press comprising: a paper web threading member guide provided along a paper web threading path of the printing press extending from a paper web supply section to a position just in front of a folding section; a paper web threading member pooling section provided downstream of the paper web threading path; a paper web threading member which is located over the whole length of the paper web threading path extending from the most upstream position thereof to the paper web threading member pooling section upon commencement of a paper web threading operation and which is run along the paper web threading member guide towards the paper web threading member pooling section during the paper web threading operation; a paper web retaining member provided on the paper web threading member for securing the paper web to be threaded along the path; and at least one paper web threading member driving unit for running the paper web threading member along the paper web threading member guide.

To achieve the above-mentioned object, according to a second aspect of the present invention, there is provided a paper web threading apparatus for a rotary printing press wherein a paper web which is threaded through a paper web threading path during a paper web threading operation is slit in the longitudinal direction into at least two parts at a predetermined place on the way of the paper web threading path so that the two divided portions of the paper can be threaded through their respective paper web threading paths, the apparatus comprising: a first paper web threading member guide provided along a paper web threading path of the printing press extending from a paper supply section to a position just in front of a folding section; a second paper web threading member guide provided along another paper web threading path of the printing press extending from a place in the vicinity of a position where the paper web is slit in the longitudinal direction thereof to a place just in front of another folding section; two paper web threading member pooling sections provided downstream of the relevant paper web threading paths; respectively; at least two paper web threading members, each of which is located over the whole length of each paper web threading path extending from the most upstream position thereof to each paper web threading member pooling section upon commencement of a paper web threading operation and each of which is run along each paper web threading member guided towards each paper web threading member pooling section during the paper web threading operation; first and second retaining members provided on the paper web threading members for securing the paper webs, respectively, to be threaded through their respective paper web threading paths; at least one paper web threading member driving unit provided per paper web threading member for running each of the paper web threading members along each of the paper web threading member guides; and an automatic retaining means installed at the most upstream position along the second paper web threading member guide and adapted to automatically secure the leading end of at least one of the divided portions of the paper web to the second paper web retaining member which is waiting at the most upstream position.

The operation of the above-mentioned paper web threading apparatus for a rotary printing press according to the present invention is as follows.

A paper web threading member pooled in a paper web threading member pooling section is run reversely by a reversely rotating driving unit along a paper web threading member guide from the downstream side of a paper web threading path to an upstream position thereof where a paper web is waiting at a paper web supply section. Subsequently, the paper web is secured to the paper web retaining member of the paper web threading member, and then the driving unit thereof is forwardly rotated to run the paper web threading member along the paper web threading member guide from the upstream side of the path to the downstream side thereof so that the paper web is threaded along the paper web threading member guide.

Further, in case the paper web is slit in the longitudinal direction thereof and the divided paper webs are threaded through their individual paper web threading paths, the paper web threading apparatus will function as follows.

That is to say, a paper web threading member pooled in a paper web threading member pooling section is run reversely by a reversely rotating driving unit along a paper web threading member guided from the downstream side of a paper web threading path to an upstream position where a paper web is waiting at a paper web supply section. Whilst, another paper web threading member pooled in another paper web threading member pooling section is run reversely, in like manner, by another reversely rotating driving unit along another paper web threading member guide from the downstream side thereof to an upstream position somewhat downstream of a position where the paper web is slit longitudinally, and is stopped there. After that, the paper web is secured to the paper web retaining member of the former paper web threading member, and then the relevant driving unit is forwardly rotated so as to run the paper web threading member along the paper web threading member guide from the upstream side thereof to the downstream side thereof to thereby thread the paper web through the paper web threading path along the paper web threading member guide.

When the above-mentioned paper web is passing through a paper web slitting position on the way of the paper web threading path, for example, a slitter actuating position, it is slit in the longitudinal direction thereof. One of the divided paper webs which is retained or secured by the paper web retaining member of the former paper web threading member is threaded through its paper web threading path as it is by causing the paper web threading member to run along the paper web threading guide from the upstream side thereof to the downstream side thereof. Whilst, the free end of the other one of the divided paper webs is moved forwards by the pushing force applied thereto by the succeeding portion thereof which continues to run downstream, and is guided onto the paper web retaining member of the other paper web threading member which is waiting at a position somewhat downstream of the position where the paper web is slit by the action of the slitter in the longitudinal direction thereof.

When the above-mentioned free end of the other one of the divided paper webs is guided onto the paper web retaining member of the other paper web threading member, the driving unit for driving the other paper web threading member begins to rotate forwardly so as to commence running of the other paper web threading member along the other paper web threading member guide from the upstream side thereof to the downstream side thereof, and also the automatic retaining member is actuated so as to secure the free end of the other one of the divided paper webs to the paper web retaining member of the other paper web threading member. Thus, the other one of the divided paper webs is threaded through the paper web threading path along the other paper web threading member guide.

In this paper web threading operation, the above-mentioned two paper web threading members are run at nearly the same speed along their respective paper web threading member guides from the upstream side of their respective paper web threading paths to the downstream side thereof.

According to the present invention, even in case the paper web is slit in the longitudinal direction thereof and then the divided paper webs are threaded through their respective paper web threading paths, it is possible to thread the divided paper webs through their respective paper web threading paths smoothly, surely and at nearly constant speed without applying any uneven tension to the paper webs.

Further, since the construction of the apparatus itself is simple, the frequency of troubles is limited, and maintenance and repairs thereof can be conducted readily, and also safe operation thereof can be achieved.

The above-mentioned and other objects, aspects and advantages of the present invention will become apparent to those skilled in the art by making reference to the following description and the accompanying drawings in which preferred embodiments incorporating the principles of the present invention are shown by way of example only.

BRIEF DESCRIPTION OF THE DRAWINGS

FIG. 4(*b*) is a sectional view taken along line IV(-*b*)—IV(*b*) in FIG. 4(*a*);

FIG. 4(*c*) is a sectional view of another embodiment of the paper web threading member;

FIG. 4(*d*) is a sectional view showing another embodiment of the paper web threading member guide and a further embodiment of the paper web threading member;

DETAILED DESCRIPTION OF THE PREFERRED EMBODIMENTS

The present invention will now be described in detail below with reference to the accompanying drawings in which several preferred embodiments thereof are shown.

Figure 10:
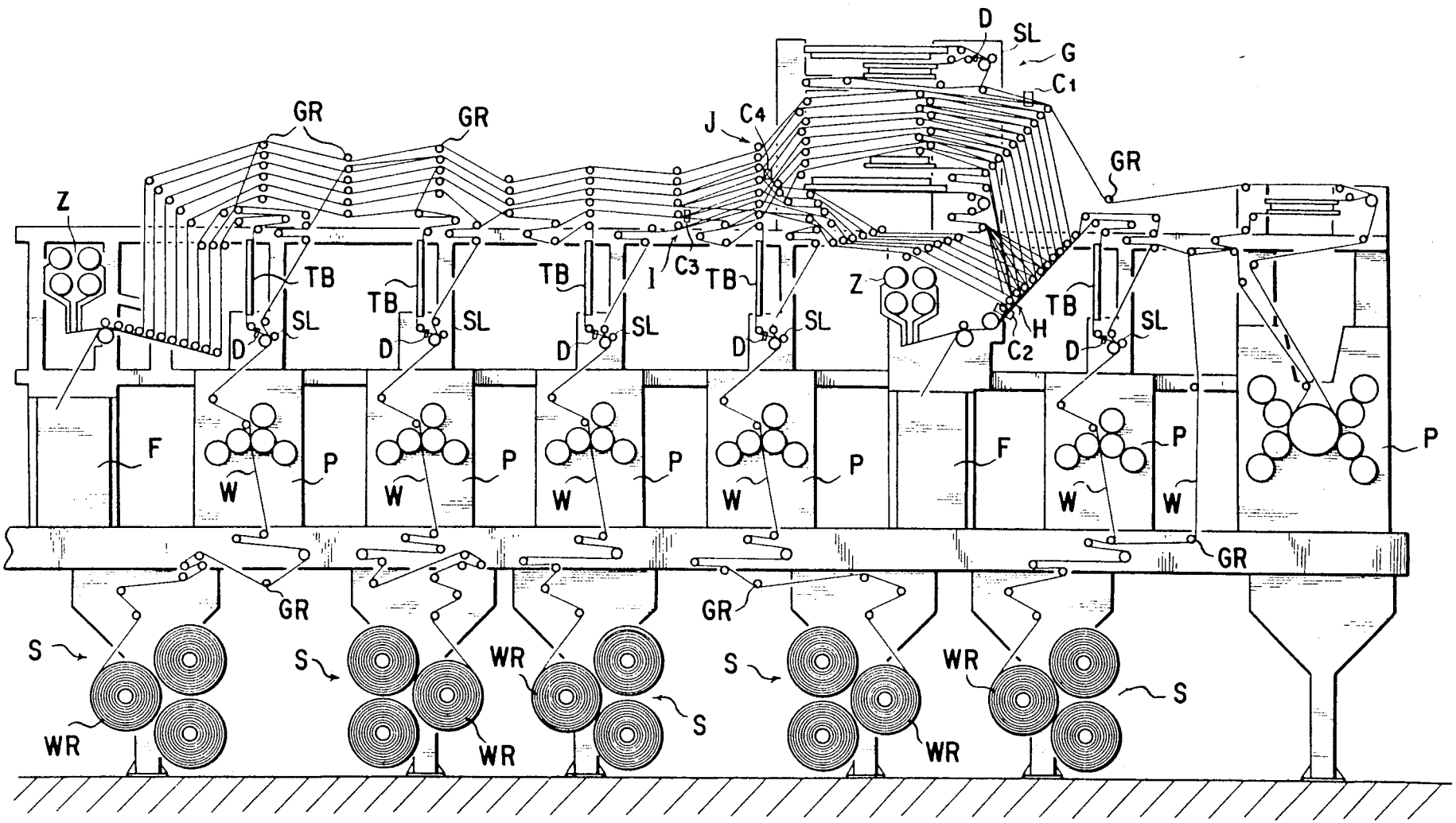
FIG. 10 is a schematic, front view showing one embodiment of the printing press in which the present invention is incorporated.

FIG. 10 shows schematically one embodiment of the printing press to which the present invention is to be applied. This printing press includes one or a plurality of paper web supply section(s) S, printing section(s) P and folding section(s) F, which are associated in corporation with one another. The paper web threading path is routed by a plurality of guide rolls GR and turning bars TB, etc., and is branched on its way so as to provide predetermined paper web threading paths each extending from the paper web supply section S through the printing section P to the folding section F.

The paper web threading apparatus for use in such a printing press is useful for drawing out a paper web W from a paper web take-up reel WR installed at each paper web supply section S, select a proper paper threading path extending from the paper web supply section S through the printing section P to the folding section F for obtaining desired printed matters, and threading the paper web along the paper web threading path. The concrete configuration of the paper web threading apparatus is as shown in FIGS. 1 to 9.

Stating more specifically, a paper web threading member guide 10 extends so as to guide a continuous paper web threading member 2 from the paper supply section S (on upstream side) to the folding section F (on downstream side) along the inside of a frame 60 (see FIGS. 4(*a*) and 5) of the printing press and on one side of each of paper web threading paths routed by a plurality of guide rollers GR and turning bars TB. The paper web threading member guide 10 is fixedly secured to the above-mentioned frame 60 through the intermediary of brackets 12, for example, as shown in FIGS. 4(*a*) and 5.

Figure 7:
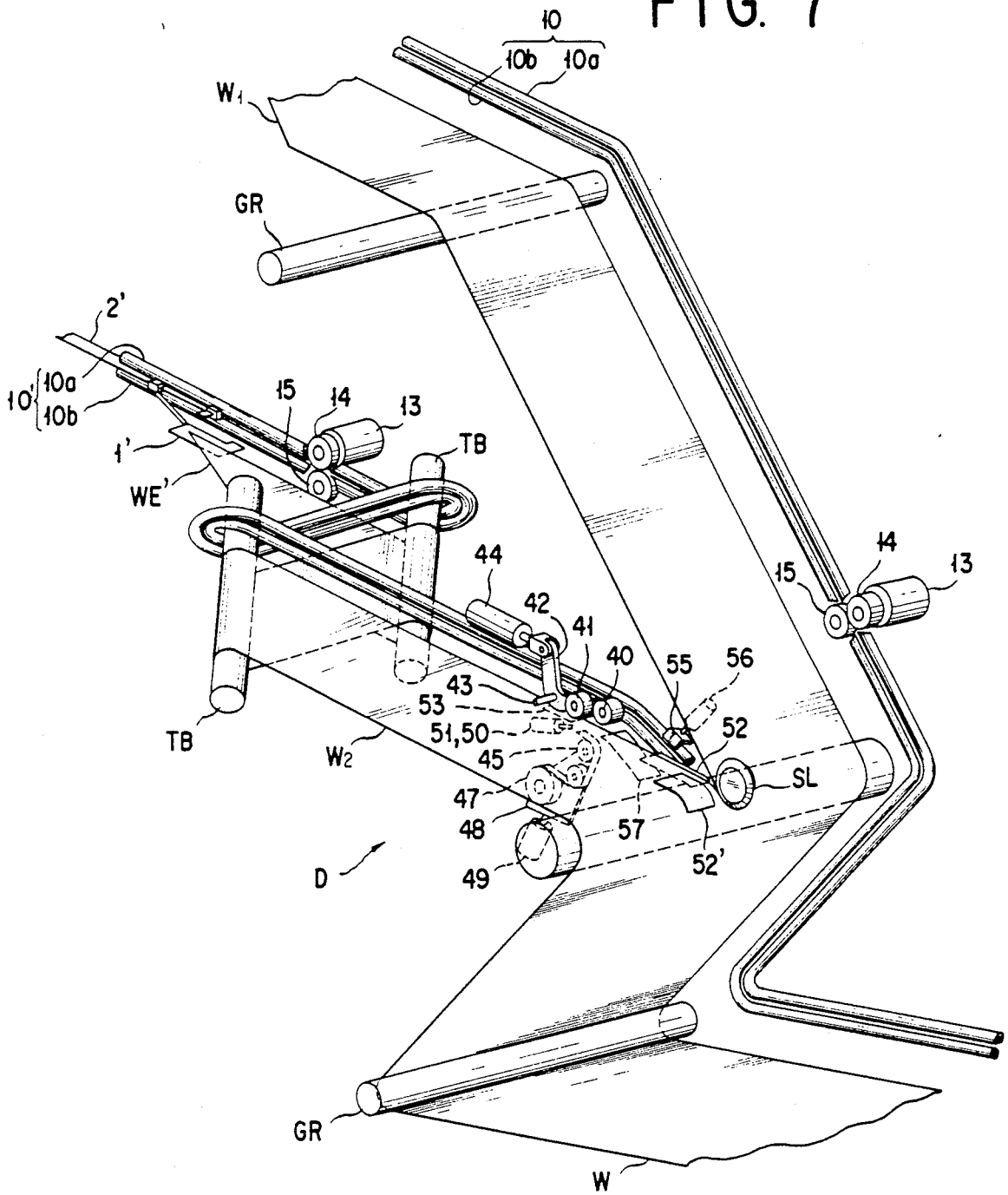
FIG. 7 is a perspective view showing the schematic configuration of the paper web threading apparatus in the vicinity of a position where a paper web is split in the longitudinal direction thereof.
Figure 8A:
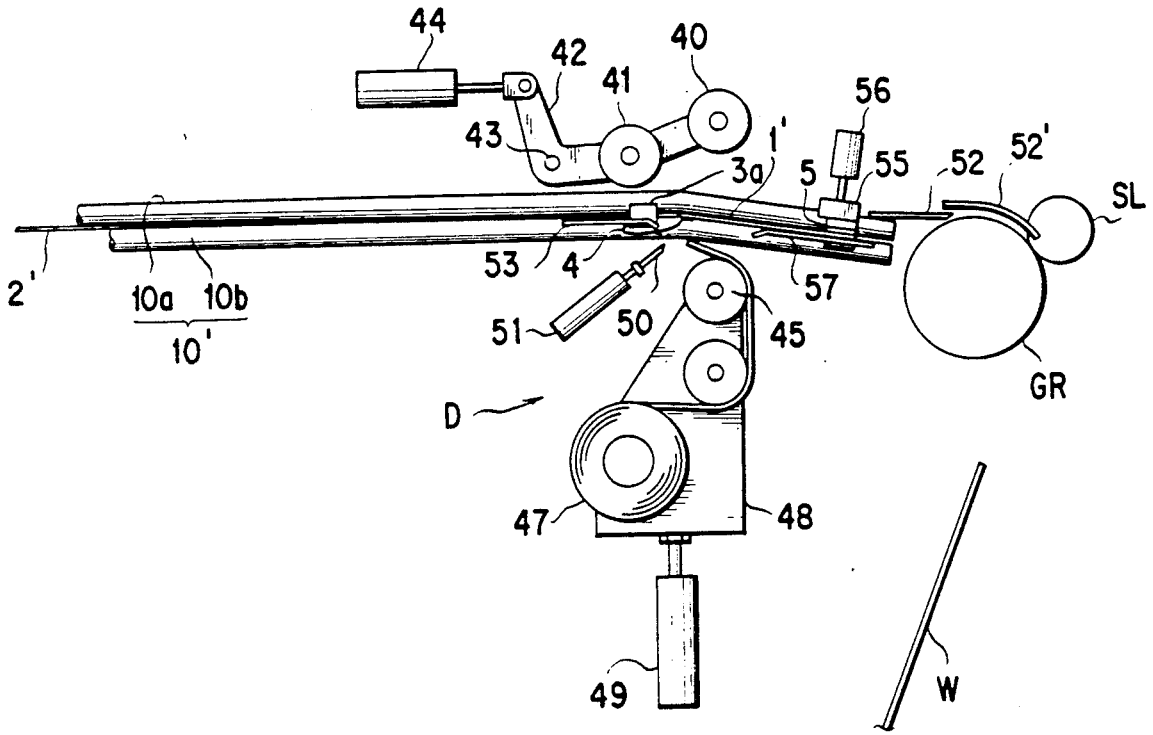
FIGS. 8(*a*) to 8(*d*) are views for explaining the operation of an automatic retaining means D.
Figure 8B:
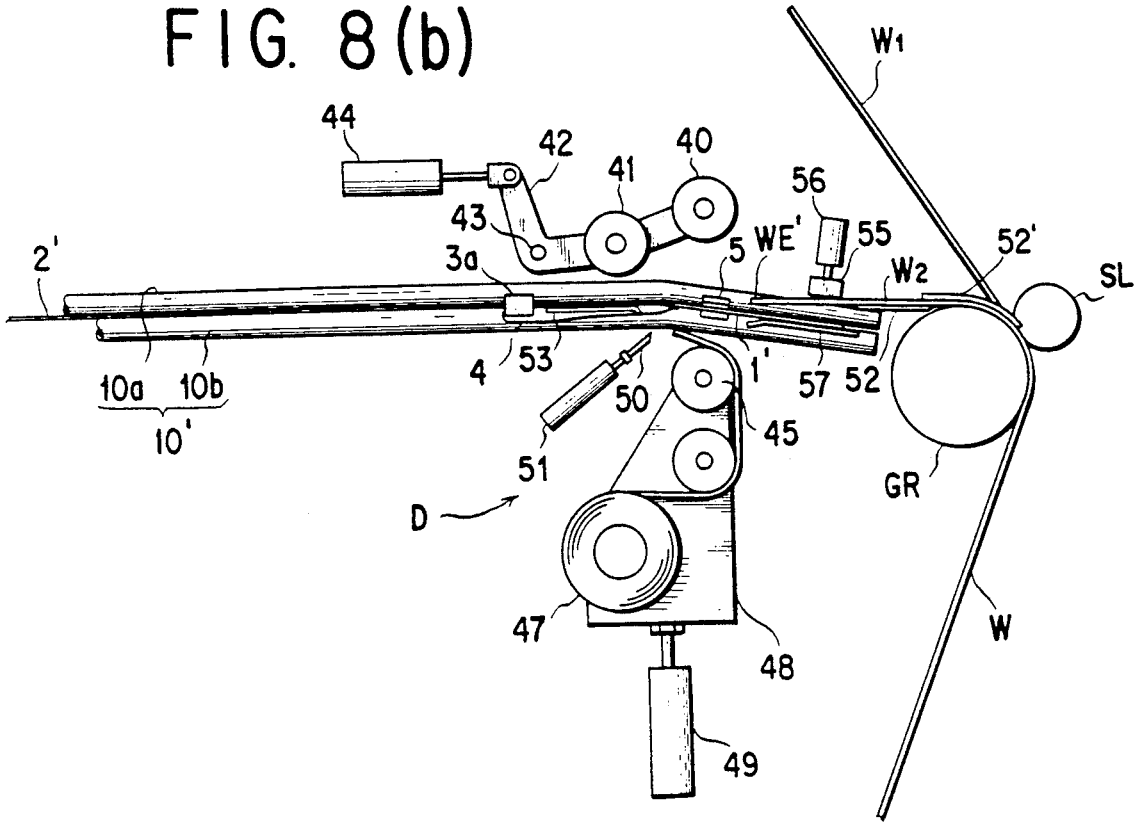
Figure 8C:
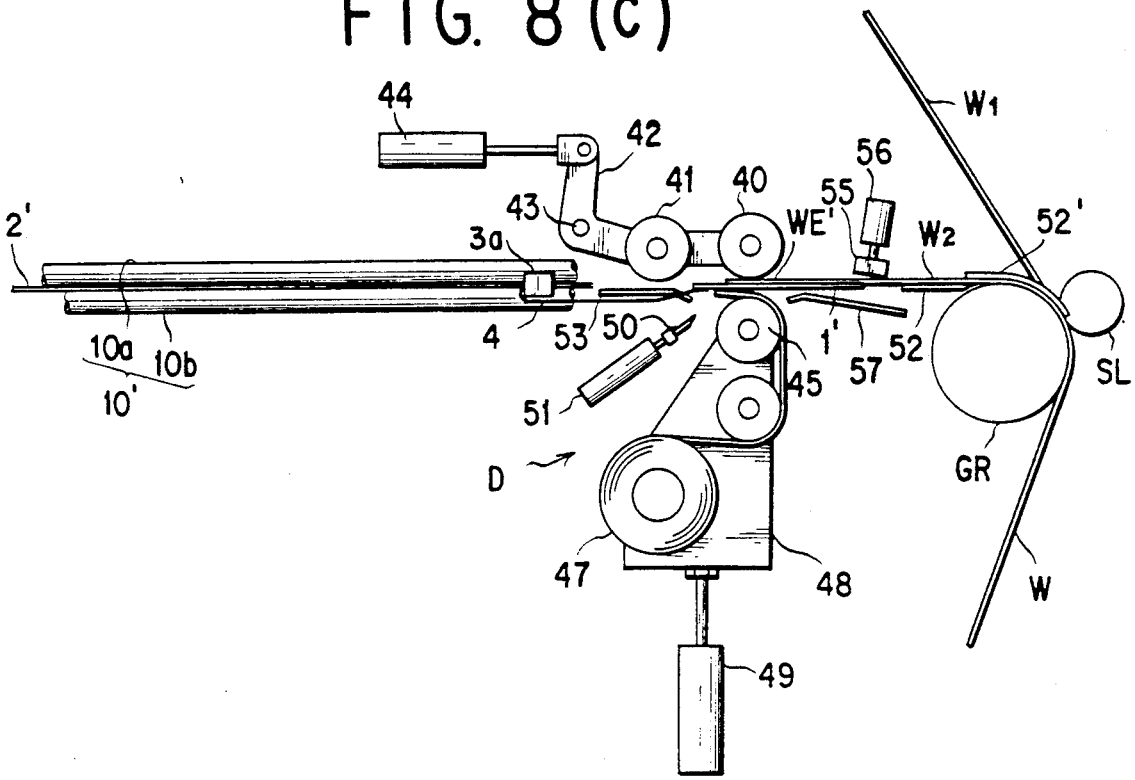
Figure 8D:
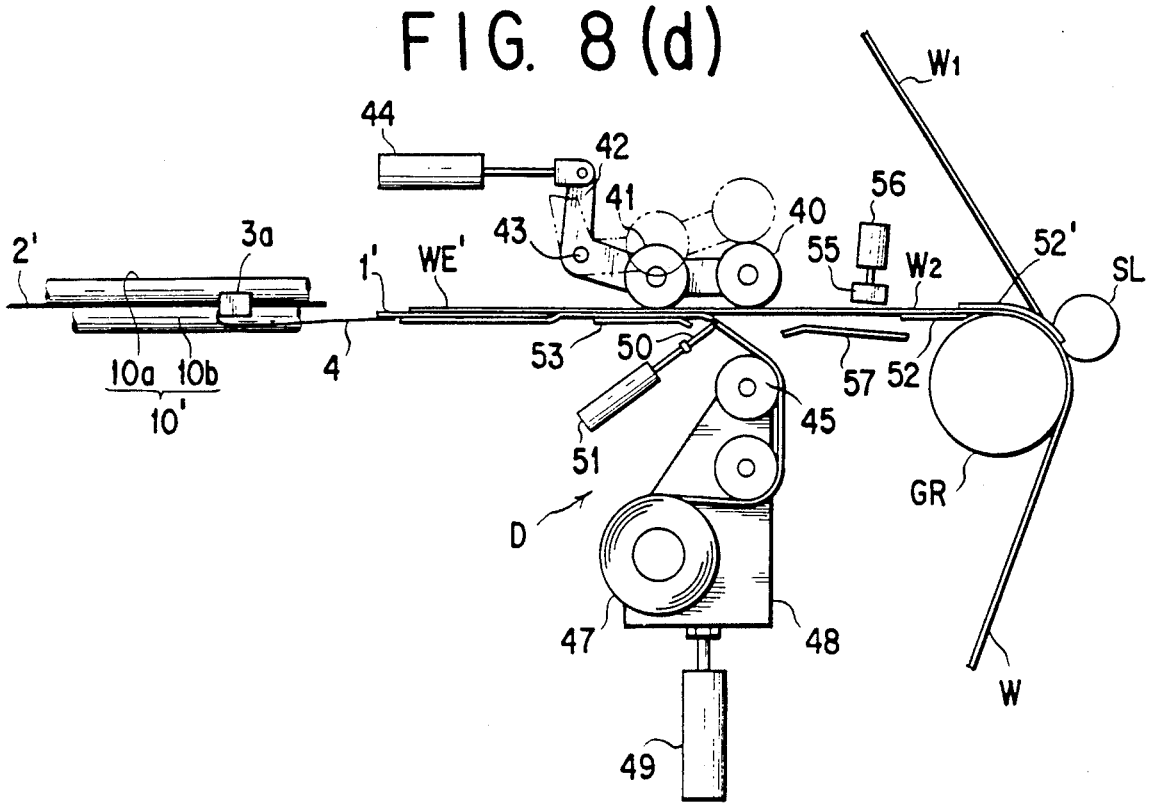

In case the paper web W is split in the longitudinal direction thereof at a predetermined position on the way of the paper web threading path as shown in FIG. 7, another paper web threading member guide 10' is provided to guide another continuous paper threading member 2' from a place in the vicinity of the position where slitter SL is actuated to the folding section F.

Hereinafter, one of the divided portions of the paper web W is referred to as "paper web $W_1$", and the other thereof as "paper web $W_2$".

Further, as shown in FIGS. 4(*b*) and 5, the paper web threading member guide 10 (10') is comprised of two guide members 10*a* and 10*b* located oppositely and in vertically spaced-apart relationship, and the clearance defined between the guide members 10*a* and 10*b* is slightly larger than the thickness of the paper web threading member 2 (2'). The arrangement is made such that the paper web threading member 2(2') is slidably moved through the clearance defined between the guide members 10*a* and 10*b*.

Further, another embodiment of each of the paper web threading member guide 10 and the paper web threading member 2, respectively, is shown in FIG. 4(*d*).

The paper web threading member 2 (2') is a continuous, strip-shaped member which is deformable in accordance with the flexure of the paper web threading member guide 10 (10'). The paper web threading member 2 (2') has two pairs of guide pieces 3*a* and 3*b*, and 3*c* and 3*d*, respectively, provided on one end thereof in spaced-apart relationship and adapted to be kept in sliding contact with the guide members 10*a* and 10*b* of the paper web threading member guide 10 (10').

The inner guide piece 3*a* out of the pair of guide pieces 3*a* and 3*b* located on the downstream side of the paper web threading path is connected to one end of a paper web retaining member 1 (1') through the intermediary of a flexible ribbon 4.

Further, the other end of the paper web retaining member 1 (1') is detachably connected to the inner guide piece 3*c* out of the pair of guide pieces 3*c* and 3*d* located on the upstream side in the paper web threading direction through the intermediary of the gripper 5 provided on the guide piece 3*c*. Moreover, the paper web threading member 2 (2') has further guide pieces (not shown) provided on both sides thereof and at regular intervals throughout the whole length thereof so as to prevent it from disengaging from the paper web threading member guide 10 (10'). Alternatively, as shown in FIG. 4(*b*), the paper web threading member 2 (2') may be provided with semispherical protrusions 2*a*, 2*a* . . . , or alternatively it may be formed as a flexible body whose both ends are of a spherical sectional shape as shown in FIG. 4(*c*).

And, the other end of the paper web threading member 2 (2') is retained by a paper web threading member pooling section A located at an appropriate position in the vicinity of the folding section F.

At an appropriate position along the paper web threading member guide 10 (10'), there is provided a driving unit B adapted to hold the paper web threading member 2 between their guide members 10*a* and 10*b* and drive it.

Figure 1:
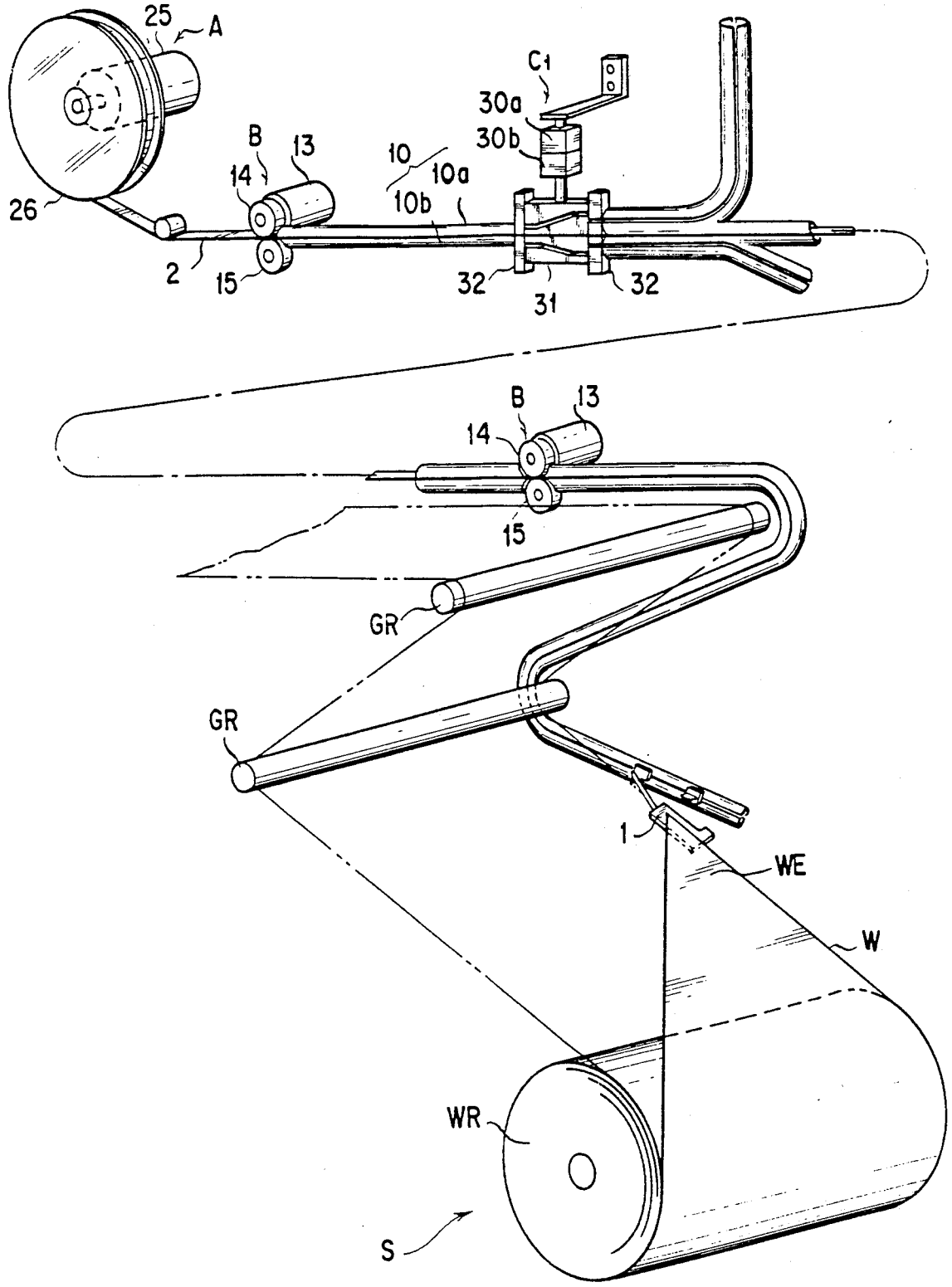
FIG. 1 is a perspective view showing the schematic configuration of one embodiment of the present invention.
Figure 2:
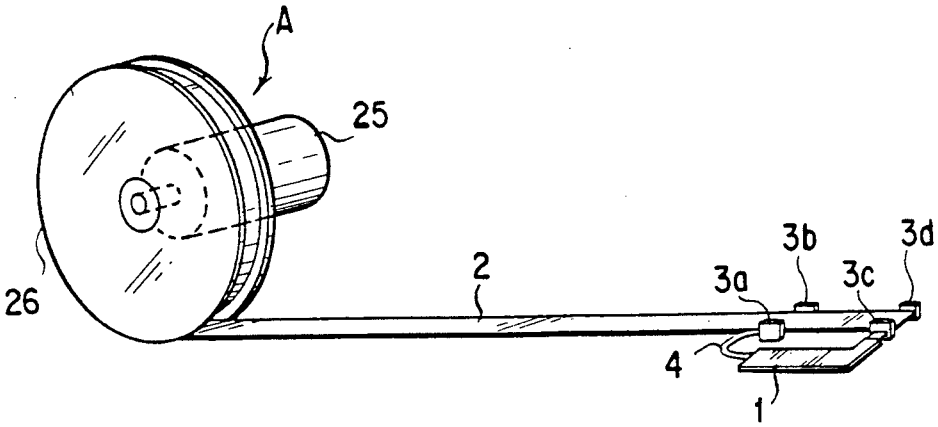
FIG. 2 is a perspective view showing a paper web threading member 2 and a paper web threading member pooling section A.
Figure 3:
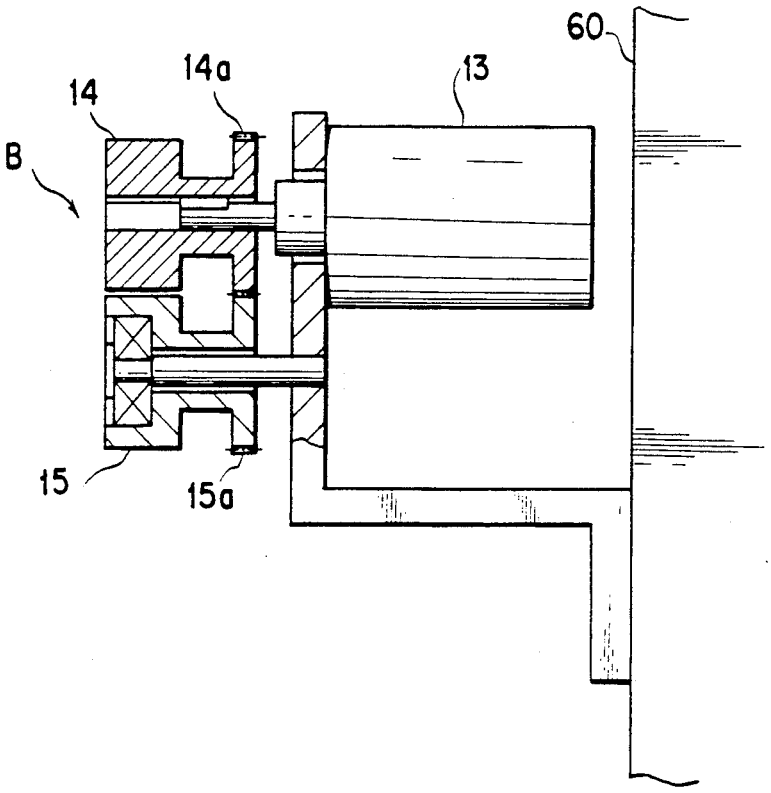
FIG. 3 is a side elevational view showing a driving unit B.
Figure 4A:
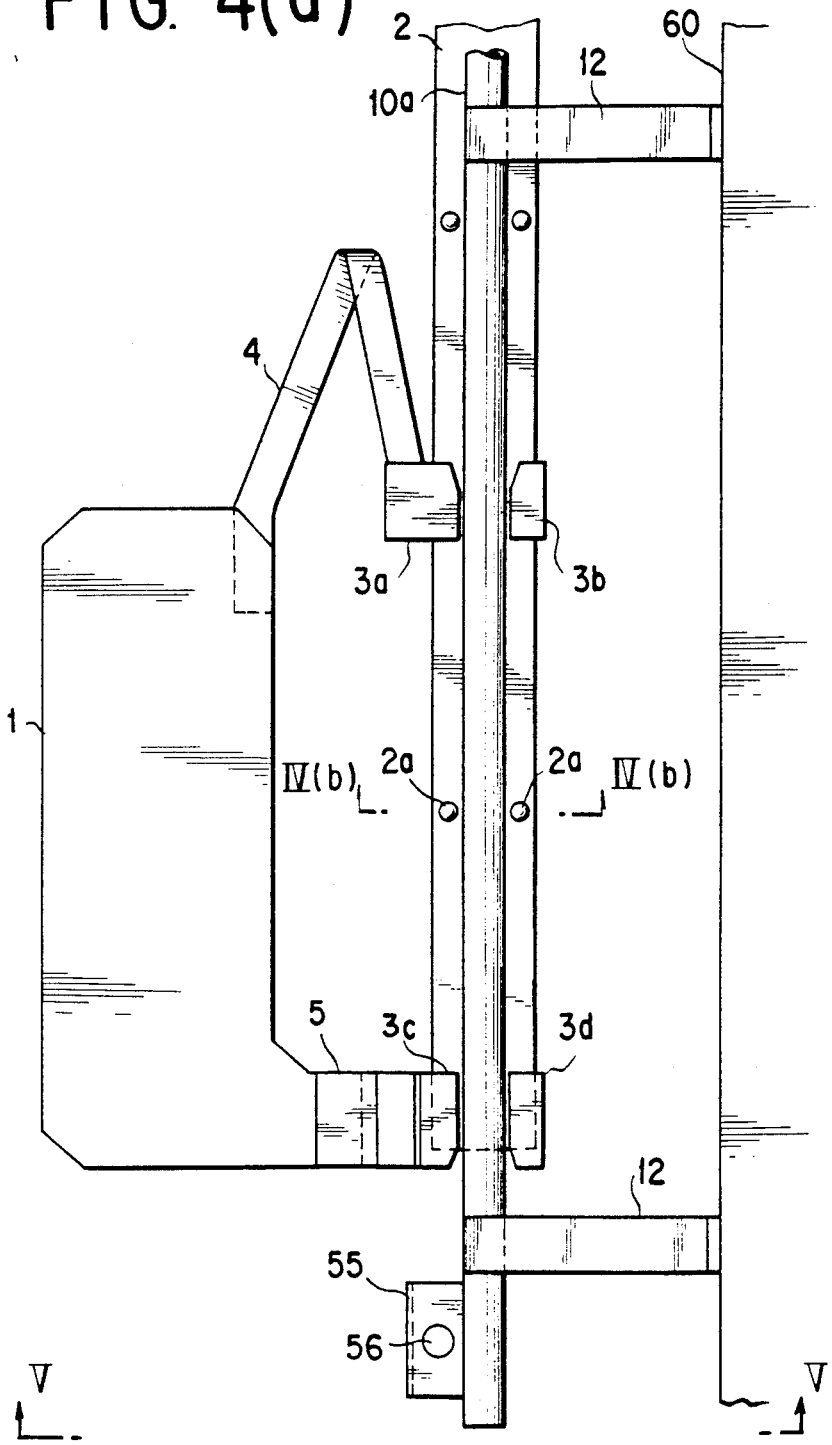
FIG. 4(*a*) is a plan view showing the paper web threading member 2 mounted on a paper web threading member guide 10.
Figure 4B:
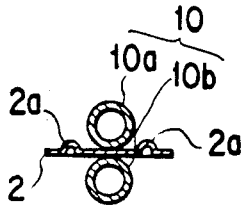
Figure 4C:
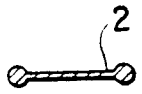
Figure 4D:
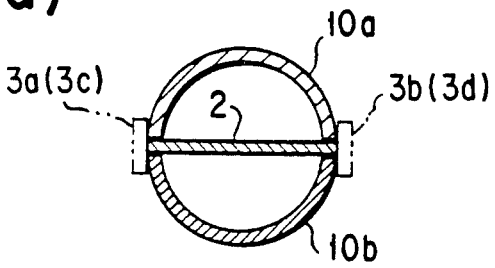
Figure 5:
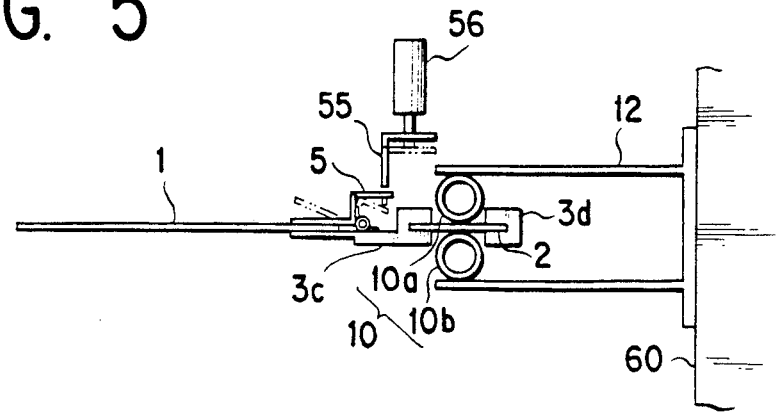
FIG. 5 is a view looking in the direction shown by arrows V, V in FIG. 4(*a*)

The driving unit B is constructed as shown in FIGS. 1 and 3 and comprises a driving member 13, a driving roller 14 fixedly secured to an output shaft of the driving member 13 and which is made of an elastic material, a driving gear 14*a* formed as an integral unit of the driving roller 14, an auxiliary roller 15 mounted so as to rotate freely at a position where the paper web threading member 2 (2') is held between the rollers 14 and 15, and a driven gear 15*a* formed integrally with the auxiliary roller 15 and which is engaged with the driving gear 14*a*. Further, one or more of driving unit B may be provided taking into consideration the resistance to running of the paper web threading member 2 (2').

Further, at positions where paper web threading paths are gathered and intricated and vicinity thereof such as, for example, positions G, H, I, J shown in FIG. 10, each of the paper web threading member guides 10 (10') is provided on the way thereof with appropriate means, such as for example branching $C_1$, $C_2$, branching means $C_2$, joining means $C_3$ and crossing means $C_4$, etc.

Figure 6A:
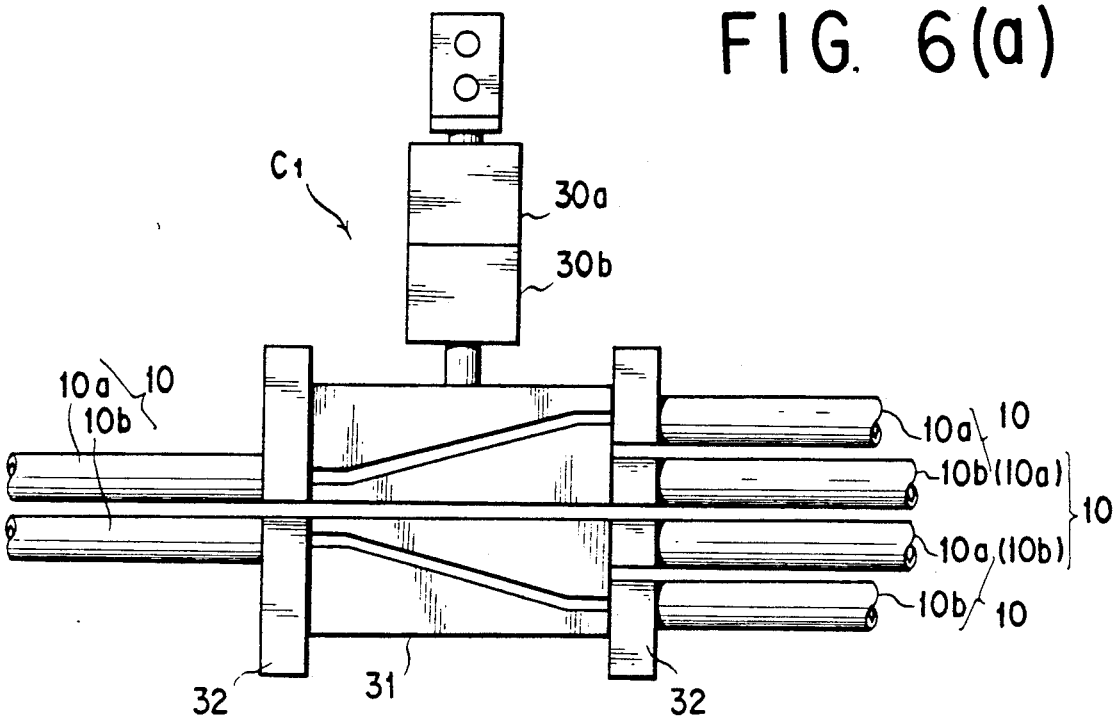
FIGS. 6(*a*) to 6(*d*) are side elevational views showing branching means, joining means and crossing means, respectively, of the paper web threading member guide.
Figure 6B:
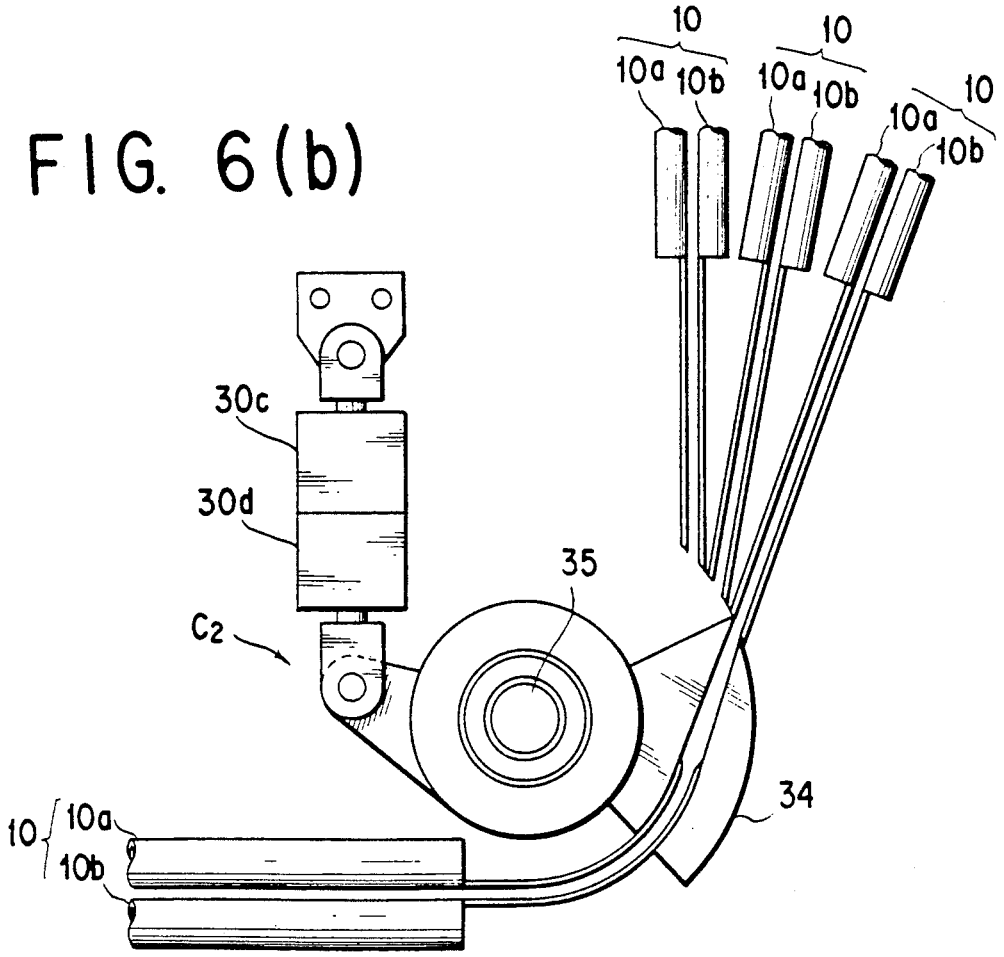

The branching means $C_1$ is constructed as shown in FIGS. 1 and 6*a* and arranged such that when piston rods in cylinders 30*a* and 30*b* are actuated a branching block 31 can be moved up or down along guides 32, 32 disposed on both sides thereof to thereby select a connection route between the upstream and downstream sides of the branching means $C_1$ of the paper web threading member guide 10 (10'). Further, the branching means $C_2$ is constructed as shown in FIG. 6(*b*) and arranged such that when piston rods in cylinders 30*c* and 30*d* are actuated a branching block 34 can be turned about a support shaft 35 so as to select a connection route between the upstream and downstream sides of the paper web threading member guide 10 (10').

Figure 6C:
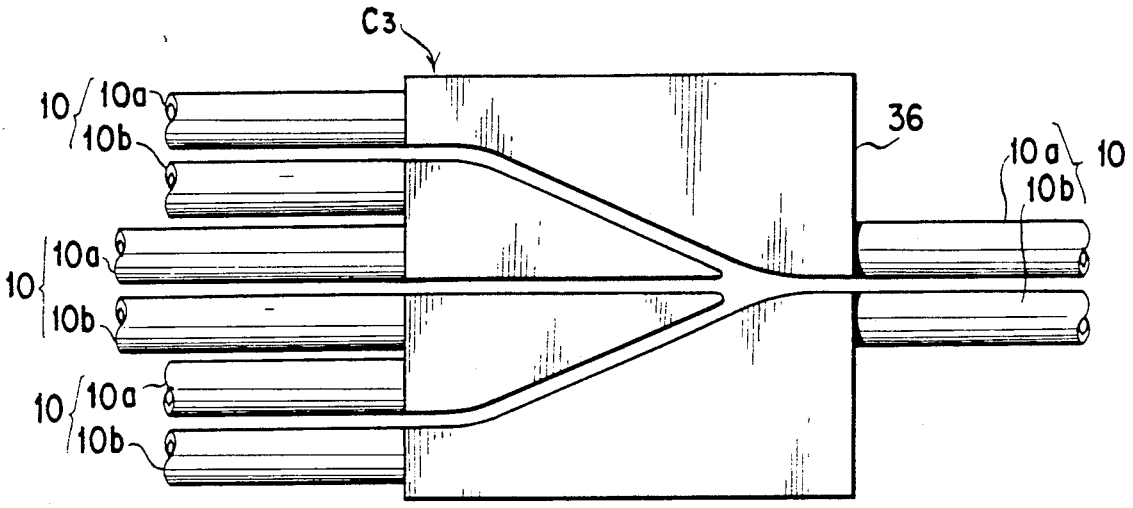
Figure 6D:
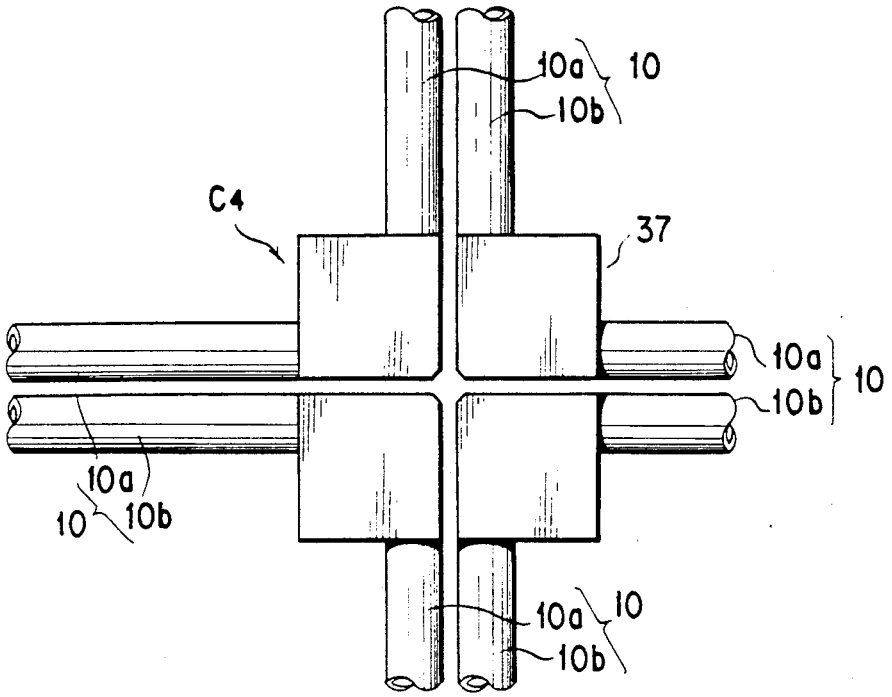

Further, the joining means $C_3$ is composed of a joining block 36 as shown in FIG. 6*c*, whilst the crossing means $C_4$ is comprised of a crossing block 34 as shown in FIG. 6(*d*) so that the upper web threading member 2 can be guided properly.

Whilst, on the donwstream side of a position where the paper web W is slit in the longitudinal direction thereof, that is to say, where the aforementioned slitter SL is actuated, there is provided an automatic retaining means D adapted to secure by adhesive-bonding the free end WE' of the other one of the two portions of the paper web W divided by the slitter SL, namely, the paper web $W_2$, onto the paper web retaining member 1' of another paper web threading member 2' which stands by downstream of the paper web threading path.

The automatic retaining means D comprises, as shown in FIGS. 7 and 8(*a*) to 8(*d*), for example, a stand-by plate 57 for supporting the front portion of the paper web retaining member 1' when the latter is waiting; guide plates 52, 52' for guiding the free end WE' of the paper web $W_2$ onto the paper web retaining member 1' which is waiting; an auxiliary plate 53 disposed away from the downstream end of the stand-by plate 57 by a predetermined space when the paper web retaining member 1' is waiting on the downstream side of the stand-by plate 57; a holding roller 45 on which a coiled adhesive tape 47 for securing the free end WE' of the paper web $W_2$ onto the other paper web retaining member 1' can be mounted and which is located below the above-mentioned space so as to hold the drawn-out end of the adhesive tape 47; an adhesive tape holder 48 adapted to move the holding roller 45 up and down by means of a hydraulic cylinder 49 relative to the paper web retaining member 1'; a first pusher roller 40 located above the aforementioned space; a pusher arm 42 including a first pusher roller 40 located above the aforementioned space and a second pusher roller 41 located above the auxiliary plate 53, the pusher arm 42 being arranged to move the first pusher roller 40 towards and away from the paper web retaining member 1' so that the roller 40 may urge against and release the free end WE' of the paper web $W_2$ guided onto the paper web retaining member 1' by the action of the hydraulic cylinder 44 which is interlocked with the aforementioned hydraulic cylinder 49, and also move the second pusher roller 41 towards and away from the auxiliary plate 53; a cutter 50 adapted to cut off the adhesive tape 47 after the free end E' of the paper web $W_2$ is secured by the tape to the paper web retaining member 1'; a hydraulic cylinder 51 for driving the cutter 50; a release cam 55 for releasing the paper web retaining member 1' from the gripper 5 of the other paper web threading member 2', which is run back along the other paper web threading member guide 10' to the downstream portion of the stand-by plate 57, onto the latter; and a hydraulic cylinder 56 for driving the release cam 55.

The operation of the paper web threading apparatus arranged as mentioned hereinabove is as follows.

First of all, the driving member 13 of the driving section or unit B is reversely rotated to run the paper web threading member 2 (2'), which is inserted between the guide members 10*a*, 10*b* of the paper web threading member guide 10 (10') and held between the driving roller 14 and the auxiliary roller 15 of the driving unit B, from the paper web threading member pooling section A towards the paper web supply section S where the paper web W is waiting (and towards the vicinity of the position where the paper web W is slit in the longitudinal direction thereof, that is, where the aforementioned slitter SL is actuated, towards the upstream side of the paper web threading path, and then stop the paper web threading member 2 (2') in the condition wherein the paper web retaining member 1 (1') provided on one end of the member 2 (2') is run back to a predetermined position where the paper web W is waiting.

Before or during the above-mentioned running of the paper web threading member 2 (2'), the aforementioned branching means $C_1$ or $C_2$ is switched over to select a desired paper web threading path.

Accordingly, the paper web threading member 2 (2') is run in the direction opposite to that in the case of threading of the paper web along the paper web threading member guide 10 (10') located along a desired paper web threading path selected by the branching means $C_1$ or $C_2$.

Subsequently, the paper web retaining member 1 of the paper web threading member 2 which has been reversely run to the position where the paper web is waiting in the paper web supply section is disengaged from the gripper 5, and then secured to the free end WE of the paper web W.

This paper web securing operation is made either manually or automatically using an adhesive-bonding means (not shown). Upon completion of the securing, the paper web threading apparatus is ready for threading of the paper web, and then paper web threading is begun.

Further, to prevent the paper web retaining member 1 (1') from interrupting the running of the paper web threading member 2 (2') during the reverse running of the paper web threading 2 (2') towards the upstream side, the other end of the paper web retaining member 1 (1') is secured by the gripper 5 to the guide piece 3*c*.

Upon completion of the above-mentioned preparation, threading of the paper web along the path is conduced by rotating forwardly the driving member 13 of the driving unit B so as to run the paper web threading member 2 held between the driving roller 14 and the auxiliary roller 15 of the driving unit B in the direction opposite to that when the operation for preparation of threading is made, that is, towards the down stream side of the paper web threading path. This causes the paper web to run together with the paper web threading member 2 along the paper web threading member guide 10 and by way of the aforementioned guide rollers GR and turning bars, etc. to the folding section F.

Whilst, in case it is desired to slit a paper web in the longitudinal direction thereof when it is on the way of the paper web threading path and then run the divided paper webs along their respective independent paths, the slitter SL is rendered operative at its actuating position to slit the paper web W longitudinally, and one of the divided paper webs, namely, the paper web $W_1$ which is secured to the paper web retaining member 1 of the paper web threading member 2 at the paper web supply section S is continuously threaded through the path as it is, whilst the free end WE' of the other one of the divided paper webs, namely, the paper web $W_2$ is secured by the action of the automatic retaining means D, which will be described in detail later, onto a paper web retaining member 1' of another paper web threading member 2' which is waiting downstream of the slitter's actuating position. After that, the other paper web threading member 2' which is waiting downstream of the path is run along the other paper web threading member guide 10' in the same manner as that in the case of threading the paper web $W_1$ from the paper supply section S through its path.

During the paper web threading operation, the other end of the paper web retaining member 1 (1') is detached from the guide piece 3*c* and is connected flexibly by the flexible ribbon 4 to the paper web threading member 2 (2').

The operation of the above-mentioned automatic retaining means D is as follows.

First of all, the other paper web threading member 2' is sent from the folding section S to the other paper web threading member guide 10' whose one end is located downstream of the slitter SL as mentioned above. When the paper web retaining member 1' held by the gripper 5 is placed on the stand-by plate 57 located on one side of the paper web threading member guide 10' and the gripper 5 is placed immediately below the release cam 55, the running of the paper web threading member 2' is stopped by the detection of a sensor (not shown). At the same time, the hydraulic cylinder 56 is actuated so that the gripper 5 is released by the pushing force applied by the release cam 55.

Further by the actuation of the above-mentioned hydraulic cylinder 56, its pusher member, not shown, is actuated so that the paper web retaining member 1' is pushed against and held under pressure on the stand-by plate 57.

Whilst, upon actuation of the hydraulic cylinder 56, the driving member 13 of the driving unit B for running the other paper web threading member 2' is rendered operative with the result that the other paper web threading member 2' is pulled until the slackened portion in the flexible ribbon 4 connecting the other paper web threading member 2' and the paper web retaining member 1' is strained. And, the gripper 5 is disengaged from the gripper 55 and closed, and the hydraulic cylinder 56 and the pusher member, not shown, associated therewith are returned to their respective original position. (Refer to FIG. 8(*a*))

By the above-mentioned operation, the paper web retaining member 1' remains on the stand-by plate 57 and stands ready for threading of the paper web.

When the paper web W passes through the position where the slitter SL is actuated, it is slit by the actuion of the slitter SL into two portions, that is, the paper webs $W_1$ and $W_2$. As the paper web $W_1$ is threaded continuously through its path as mentioned above, the free end WE' of the other paper web $W_2$ is moved downstream by the pushing force applied by the succeeding portion thereof and is guided by the guide plates 52, 52' onto the paper web retaining member 1' which is waiting for the paper web. (Refer to FIG. 8(*b*))

When the free end WE' of the other paper web $W_2$ guided by the guide plates 52, 52' is placed under the first pusher roller 40, a sensor, not shown, will detect this condition so that the hydraulic cylinders 44 and 49 are actuated nearly at the same time. As a result, the first pusher roller 40 mounted on the pusher arm 42 adapted to be pivoted about the support shaft 43, and the holding roller 45 mounted on the adhesive tape holder 48 will hold under pressure therebetween the adhesive tape 47 whose drawn-out end is held by the holding roller 45 and whose adhesive-bond surface is kept so as to face the paper web retaining member 1', the paper web retaining member 1' itself, and the free end WE' of the paper web $W_2$. And, at the same time, the second pusher roller 41 mounted on the pusher arm 42 is pressed against the auxiliary plate 53.

Almost at the same time, the driving member 13 of the driving unit B is actuated so as to move the other paper web threading member 2' to the downstream side of the path along the other paper web threading member guide 10' together with the paper web retaining member 1' connected thereto by the intermediary of the flexible ribbon 4.

This movement of the paper web retaining member 1' allows the adhesive tape 47 to be drawn out continuously around the peripheral surface of the above-mentioned holding roller 45 and to secure by its adhesion the free end WE' of the paper web $W_2$ to the paper web retaining member 1'. At that time, for the purpose of reinforcement of the paper web $W_2$, a proper length of the take 47 is adhesively bonded onto the side edge of the paper web $W_2$.

Further, the portion of the paper web $W_2$ which is applied with the adhesive tape 47 by the movement of the paper web retaining member 1' will then pass through between the auxiliary roller 41 and the auxiliary plate 53 so that the adhesion of the tape 47 onto the paper web $W_2$ is ensured by the action of the auxiliary roller pushing against the auxiliary plate 53. (Refer to FIG. 8(C))

Upon adhesive bonding of a proper length of the adhesive tape 47 onto the side edge of the other paper web $W_2$ as mentioned above, the hydraulic cylinder 49 is returned to its original position so as to move the holding roller 45 away from the paper web $W_2$. Subsequently, the piston rod in the hydraulic cylinder 51 is extended so as to render the cutter 50 operative to cut off the adhesive tape 47 which is strained between the paper web $W_2$ and the holding roller 45.

After the cut-off end of the above-mentioned adhesive tape 47 has passed through between the auxiliary roller 41 and the auxiliary plate 53 so as to complete the adhesion of the tape onto the paper web $W_2$ by the pushing of the roller 41 down against the plate 53, the piston rod in the hydraulic cylinder 44 is retracted to its original position to thereby move the pusher arm 42 away from the paper web $W_2$ as shown by dotted-dash lines in FIG. 8(*d*).

By the above-mentioned operation of the automatic retaining or securing means D, the free end WE' of the paper web $W_2$ is secured automatically by means of the adhesive tape 47 to the paper web retaining member 1', and the paper web $W_2$ is threaded through the paper web threading path as mentioned above.

Further, the control of the whole operation of threading of the paper web is performed by a proper controlling system.

The present invention is not to be limited to the arrangement of the above-mentioned embodiment, and any form or arrangement thereof is applicable provided that the threading of paper web can be conducted by sending back a continuous paper web threading member from the downstream side of the paper web threading path to the upstream side thereof, securing the paper web to the paper web threading member, and then running the latter to the downstream side of the path.

While the stripe-shaped paper web threading member 2 (2') is used in the above-mentioned embodiment, a rope-shaped, cord-shaped or chain-shaped and elongated continuous flexible one may be used as the member 2 (2'). As a further alternative, one which has a different shape on the way thereof may be used.

Figure 9:
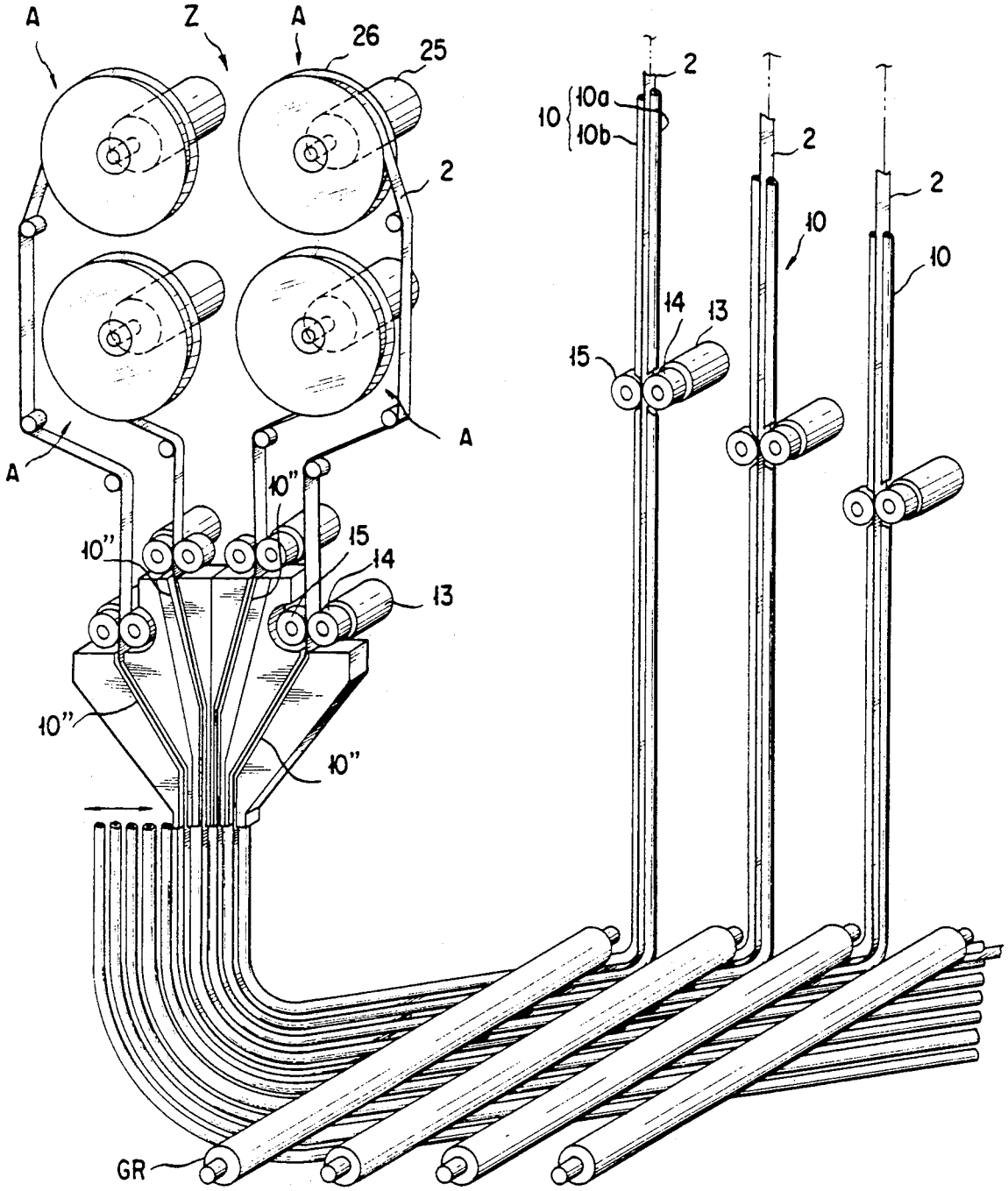
FIG. 9 is a perspective view showing a group Z of paper web threading member pooling sections.

Further, if a plurality of paper web threading member pooling sections A are gathered into a group Z so as to correspond to their respective paper web threading paths as shown in FIGS. 9 and 10, then the paper web threading efficiency can be improved. Further, in the paper web threading member pooling section group Z, by moving paper web threading member pooling sections A together with the relevant auxiliary guides 10 by a proper means (not shown) in any of the directions shown by arrows X, the paper web threading member pooling sections A, A . . . can be connected sequentially and/or as desired to any selected ones out of the paper web threading member guides 10, 10 . . . , the number of which is more than the number of the paper web threading member pooling sections A, A . . . Yet further, it is not always necessary that the paper web threading member pooling section A should be of the type comprised of a take-up reel 26 provided with a take-up torque generator means 25 as illustrated in the embodiment shown in the drawings. As an alternative, a member of the type adapted to be merely pulled back and whose one end is kept free may be used.

Further, the sectional shape of each of the guide members 10*a* and 10*b* of the paper web threading member 2 (2') is not to be limited to the circular type as shown in FIGS. 4(*b*) and 5, and instead the member 2 (2') may be U-shaped, semi-circular, flat-plate shaped, or T-shaped. Still further, winding of the paper web threading member 2 round the reel 26 of the paper web threading member pooling section A may be conducted by directly driving the reel 26 by a proper means. In this case, since the paper web threading member 2 (2') is run at a predetermined, fixed speed, it is necessary to change the rotational speed of the paper web threading member 2 (2') in accordance with changes in the diameter of the member 2 (2') wound round the reel 26 due to changes in the amount thereof taken up.

Moreover, in the automatic retaining or securing means D, it is possible to secure the free end WE' of the paper web $W_2$ onto the paper web retaining member 1' and supply the adhesive tape for reinforcing the paper web $W_2$ from the side of the pusher arm 42, and also use double-coated adhesive tape.

In any case, the paper web threading apparatus according to the present invention is intended to involve any changes in the design thereof which do not depart from the annexed claims of the invention.

It is to be understood that the foregoing description is merely illustrative of preferred embodiments of the present invention, and that the scope of the present invention is not to be limited thereto, but is to be determined by the scope of the appended claims.

What is claimed is:

1. A paper web threading apparatus for a rotary printing press comprising: a paper web threading member guide provided along a paper web threading path of the printing press extending from a paper web supply section to a position just in front of a folding section; a paper web threading member pooling section provided downstream of the paper web threading path; a paper web threading member which is located over the whole length of said paper web threading path extending from the most upstream position thereof to said paper web threading member pooling section upon commencement of a paper web threading operation and which is run along said paper web threading member guide towards said paper web threading member pooling section during the paper web threading operation; a paper web retaining member provided on said paper web threading member for securing the paper web to be threaded along the path; and at least one paper web threading member driving unit for running said paper web threading member along said paper web threading member guide.

2. A paper web threading apparatus for a rotary printing press as claimed in claim 1, characterized in that said paper web threading member guide is provided with branching means and/or joining means on the way thereof.

3. A paper web threading apparatus for rotary printing press wherein a paper web which is threaded through a paper web threading path during a paper web threading operation is slit in the longitudinal direction into at least two parts at a predetermined place on the way of the paper web threading path so that the two divided portions of the paper web can be threaded through their respective paper web threading paths, the apparatus comprising: a first paper web threading member guide provided along a paper web threading path of the printing press extending from a paper web supply section to a position just in front of a folding section; a second paper web threading member guide provided along another paper web threading path of the printing press extending from a place in the vicinity of a position where the paper web is slit in the longitudinal direction thereof to a place just in front of another folding section; two paper web threading member pooling sections provided downstream of the relevant paper web threading paths, respectively; at least two paper web threading members, each of which is located over the whole length of each paper web threading path extending from the most upstream position thereof to each paper web threading member pooling section upon commencement of a paper web threading operation and each of which is run along each paper web threading member guide towards each paper web threading member pooling section during the paper web threading operation; first and second paper web retaining members provided on said paper web threading members for securing the divided paper webs, respectively, to be threaded through their respective paper web threading paths; at least one paper web threading member driving unit provided per paper web threading member for running each of said paper web threading members along each of said paper web threading member guides; and an automatic retaining means installed at the most upstream position along said second paper web threading member guide and adapted to automatically secure the leading end of at least one of the divided portions of the paper web to said second paper web retaining member which is waiting at said most upstream position.

4. A paper web threading apparatus for a rotary printing press as claimed in claim 3, characterized in that said first paper web threading member guide and/or said second paper web threading member guide are (or is) provided with branching means and/or joining means on the way thereof.

* * * * *